US007360573B2

(12) United States Patent
Yu et al.

(10) Patent No.: US 7,360,573 B2
(45) Date of Patent: Apr. 22, 2008

(54) SECUREMENT INSERT FOR A HEAD RAIL

(75) Inventors: Fu-Lai Yu, Taipei Hsieh (TW); Chin-Tien Huang, Taipei Hsieh (TW)

(73) Assignee: Teh Yor Co., Ltd. (TW)

( * ) Notice: Subject to any disclaimer, the term of this patent is extended or adjusted under 35 U.S.C. 154(b) by 325 days.

(21) Appl. No.: 11/072,955

(22) Filed: Mar. 3, 2005

(65) Prior Publication Data

US 2006/0196615 A1 Sep. 7, 2006

(51) Int. Cl.
*E06B 9/30* (2006.01)

(52) U.S. Cl. ..... 160/84.05; 160/178.1 R

(58) Field of Classification Search ..... 160/84.04, 160/84.05, 168.1 R, 173 R, 178.1 R
See application file for complete search history.

(56) References Cited

U.S. PATENT DOCUMENTS 4,647,488 A * 3/1987 Schnebly et al. ..... 428/116
4,842,034 A * 6/1989 Haines ..... 160/84.04
5,195,569 A * 3/1993 Peterson et al. ..... 160/84.06
5,701,940 A * 12/1997 Ford et al. ..... 160/84.05
6,056,036 A * 5/2000 Todd et al. ..... 160/84.05
6,769,471 B2 * 8/2004 Voss et al. ..... 160/84.05
6,957,680 B2 * 10/2005 Anderson et al. ..... 160/84.05
2003/0090123 A1 * 5/2003 Sturt ..... 296/97.8
2004/0182522 A1 * 9/2004 Strand et al. ..... 160/84.05
2004/0226662 A1 * 11/2004 Tyner ..... 160/84.04

* cited by examiner

*Primary Examiner*—Blair M. Johnson
(74) *Attorney, Agent, or Firm*—Olson & Cepuritis, Ltd.

(57) ABSTRACT

Cellular panels may be suspended from head rails through the use of a rigid strip of material positioned with the cellular panel. In order to securely position the rigid strip and cellular panel with respect to the head rail, a securement insert is provided. The securement insert includes a cap securable with the head rail by an interference fit and a slot member including a restricting member extending from the cap.

6 Claims, 4 Drawing Sheets

SECUREMENT INSERT FOR A HEAD RAIL

TECHNICAL FIELD OF THE INVENTION

The present invention relates to window coverings that include a cellular structure, such as a honeycomb panel. More particularly the present invention relates to a device for securing the cellular structure with a head rail.

BACKGROUND OF THE INVENTION

Conventional cellular window shades are well known in the art. These shades, which are typically referred to as honeycomb shades or panels, include shading cells made of flexible materials that are suspended from a head rail and connected to the head rail by one or more control members, such as cords. As with many types of window coverings, the head rail is secured to a window frame or other architectural substrate to fix the window covering in the desired opening. Cellular window shades are opened and closed by collapsing or expanding the cellular panels, such as by raising or lowering the control member.

A cellular panel may be suspended from the head rail by securing a portion of the uppermost cell of the array with the head rail itself. For example, a rigid strip of material can be inserted into the uppermost shading cell of the cellular panel so that this uppermost shading cell with the rigid strip can be positioned with the head rail. To support the strip, the head rail may define a pair of braces that support the rigid strip and the uppermost cell such that the rest of the cellular structure is suspended therefrom.

In addition to supporting the shading cells, it is desirable that the position of the shading cells relative to the head rail be maintained. More particularly, it is desired that the uppermost shading cell and the head rail not be movable relative to one another due to the potential for misalignment of the cells, and undue wear to the cellular material caused by rubbing with the head rail. Different fastening techniques have been utilized to operatively secure the shading cells to the head rail. For example, the rigid strip may be inserted along with the uppermost shading cell and a side cover inserted into the head rail to prevent lateral movement of the rigid strip and uppermost shading cell. This side cover limits the lateral movement and prevents the strip or the cellular panel from sliding out of the head rail, such as during installation. Unfortunately, the described method is ineffective to prevent smaller shifts or movements of the rigid strip or uppermost shading cell while in the head rail. For example, the forces exerted by the user when opening or closing the window covering can cause minor shifts in position of the material relative to the head rail or control members, which are typically guided through holes in the panel. Over time, this movement can result in damage to the cellular panel.

Another method for securing the rigid strip and uppermost cell in the head rail employs an adhesive to attach the rigid strip to the uppermost shading cell. The combination of the strip and cell are then held via an interference fit within the head rail. The adhesive may also be used to secure the shading cell to the side cover or cap of the head rail. The uppermost shading cell with its rigid strip is then inserted into the head rail until the side cover covers and caps an open end of the head rail. While this method prevents the relative movement of the strip, the method is cumbersome and inefficient because the glue is typically applied uniformly on the surface of the strip to adhere to the interior of the uppermost shading cell, and the insertion of the rigid strip into the cell may rip the flexible material as it is inserted. The adhesive also makes the insertion of the strip into the cell difficult. Also, since the uppermost shading cell and the rigid strip are secured to one another before insertion into the head rail, the flexible material of the uppermost cell may be damaged during assembly. Further, the rigid strip, cellular panel, and end cap are permanently affixed to one another, thereby limiting the ability to repair, clean, or replace the cellular panel.

Accordingly, there is a need for a window covering with an improved fastening device for securely assembly shading cells with a head rail that allows greater flexibility.

SUMMARY OF THE INVENTION

A securement insert for a window covering that is securable with a head rail of the window covering is provided. A window covering for which the present invention is suitable typically includes a cellular panel which is connected to the head rail by one or more control members such as control cords. An example of such a head rail is commonly known as a honeycomb shade. The head rail includes an elongated body that extends substantially the entire width of the honeycomb structure. The head rail also includes a pair of braces that extend in a first direction from the body. The braces, which also preferably extend substantially the entire width of the honeycomb structure, are positioned on opposite edges of the body. Each of the braces further defines a shelf portion that extends perpendicularly from its respective brace towards the opposite brace, such that a pair of opposed supporting members are provided.

A rigid strip, which may be made of any suitable material, such as a hard plastic, thin lightweight metal, wood strip, or the like, is positioned with an uppermost cell of the cellular panel, such as by inserting the rigid strip into the uppermost cell. The rigid strip is supported within the head rail such that the honeycomb structure is suspended therefrom. In particular, the rigid strip, which also extends substantially the entire width of the cellular panel, is supported across marginal edge portions by the shelf portions of the pair of braces of the head rail discussed above. It is preferred to position the rigid strip within the uppermost cell, however, it is also possible to adhere or otherwise secure the strip on an outer portion of the uppermost cell.

In order to securely position the rigid strip and cellular panel with respect to the head rail, a securement insert is provided. The insert includes a cap securable with the head rail by an interference fit and a slot member extending from the cap. The slot member is configured to receive an end portion of the rigid strip and uppermost cell therein, and is preferably integrally formed with the cap. For example, the slot member includes a pair of opposed brackets for receiving edge portions of the rigid strip, and includes a restricting member for securing the end portion of the rigid strip and uppermost cell with the slot member.

The restricting member detachably secures the rigid strip and uppermost cell to the insert. For example, the restricting member can be an integrally formed detent member that latches the rigid strip and uppermost cell. Alternatively, the restricting member can be a removably engageable pin, such as a threadably engageable screw or a spring biased post, which holds the rigid strip and uppermost cell in position.

It should be evident that, when installed, the rigid strip and uppermost cell are secured with the head rail by being secured to the insert, which is secured to the head rail by way of an interference fit. This interference fit can be accomplished in any number of ways, such as projections extending from the cap which are lodged with the head rail or a gutter portion into which the end of the head rail is inserted. If desired, additional securement means can also be used to secure the insert to the head rail, such as adhesive or mechanical means. As such, an easily assembled yet stable securement means is provided for the window covering so that the position of the uppermost cell and rigid strip supporting the cellular structure relative to the head rail is maintained.

A bottom rail may also be provided that is secured to a lowermost cell of the cellular panel. The bottom rail provides added weight to cause the cellular panel to expand as the control cords are extended.

DESCRIPTION OF THE PREFERRED EMBODIMENTS OF THE INVENTION

Figure 1:
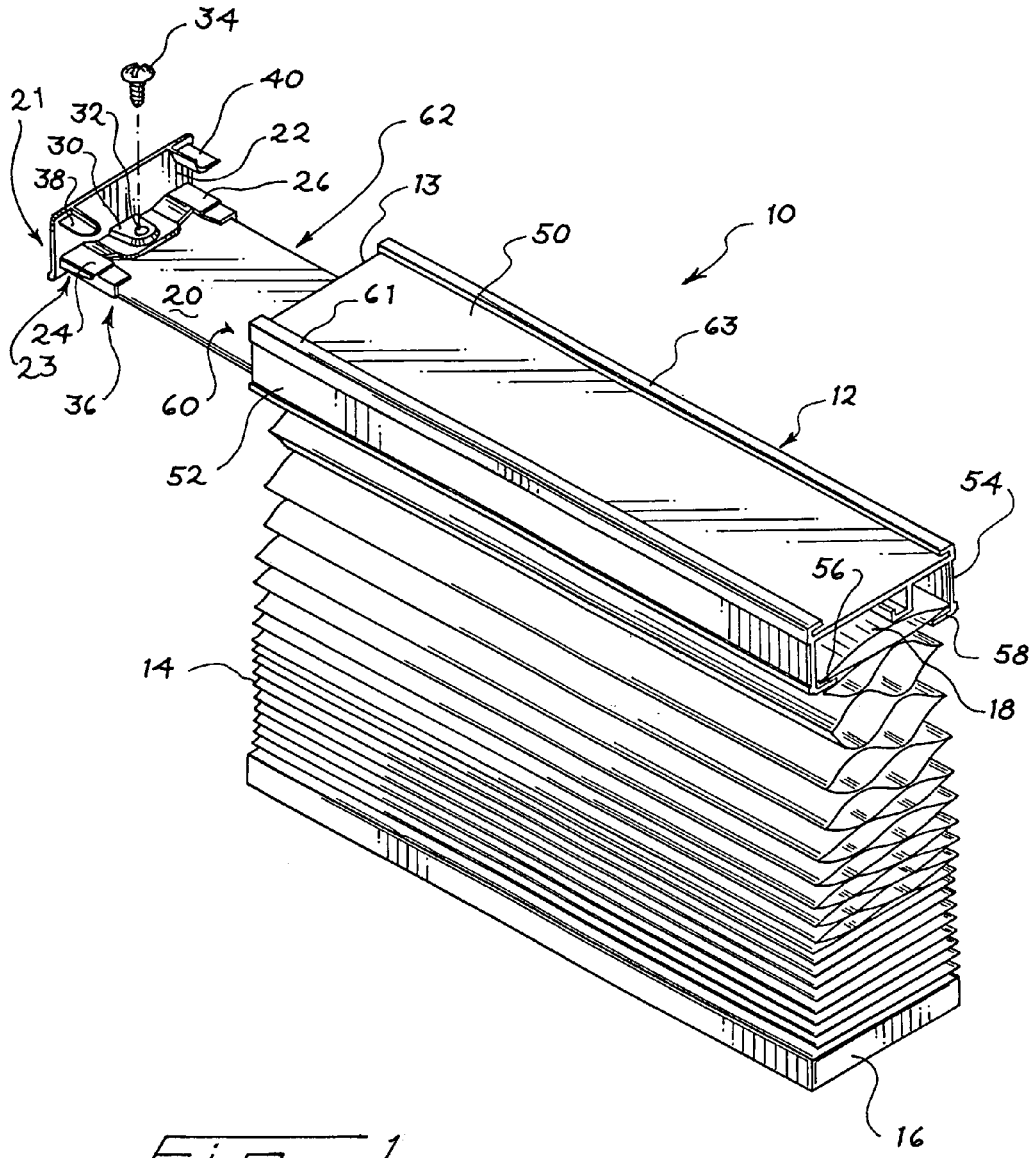
FIG. 1 is an exploded perspective view of a preferred embodiment of a window covering according to the present invention.

The invention disclosed herein is susceptible of embodiment in many different forms. Shown in the drawings and described hereinbelow in detail are preferred embodiments of the invention. It is to be understood, however, that the present disclosure is but an exemplification of the principles of the invention and does not limit the invention to the illustrated embodiments.

Figure 2:
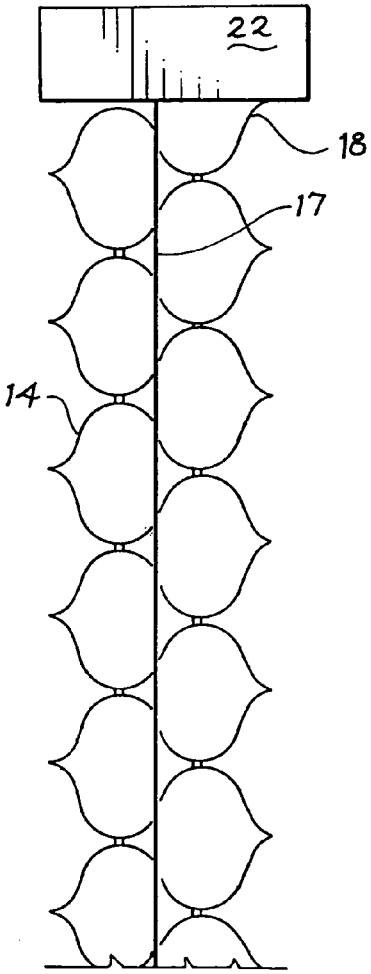
FIG. 2 is a side elevated view of the window covering of FIG. 1.

One preferred embodiment of the present invention is described with reference to FIGS. 1-4. Shown in FIG. 1 is a window covering 10 that includes a head rail 12, a cellular panel 14, and a bottom rail 16. The cellular panel 14 and bottom rail 16 are connected to the head rail 12 by a control member, such as cord 17 (FIG. 2). By extending or retracting the control cord 17, the cellular panel 14 is expanded or contracted, thereby raising or lowering the window covering 10. The cellular panel 14 is formed from a flexible material, such as a woven or non-woven fabric, laminate, film, or the like. The cellular panel 14 also defines an uppermost cell 18.

Referring again to FIG. 1, the head rail 12 includes an elongated body 50 extending substantially the entire width of the cellular panel 14. A pair of braces 52 and 54 extend in a first direction from the elongated body 50, in particular, the braces 52 and 54 extend downwards from the body 50 in a direction opposite from the surface that is intended to be mounted with a window frame. Each of the braces 52 and 54 also includes a shelf portion 56 and 58, respectively, which extend towards one another perpendicular to the braces 52 and 54.

Mounting of the head rail with the window frame can be done in any manner known in the art. In this particular example, the head rail 12 is mountable with a window frame by engaging a pair of rails 61 and 63 with a mounting bracket (not shown) that is secured to a window frame.

In order to suspend the cellular panel 14 from the head rail 12 a rigid strip 20 is inserted into the uppermost cell 18. The rigid strip 20 and uppermost cell 18 are then positioned within the head rail 12. Specifically, the rigid strip 20 and uppermost cell 18 are supported within the head rail by supporting the marginal portions 60 and 62 of the rigid strip 20 with shelf portions 56 and 58. A portion of the uppermost cell 18 passes through the space between the shelf portions 56 and 58 such that the remainder of the cellular panel 14 is suspended therefrom.

Figure 3:
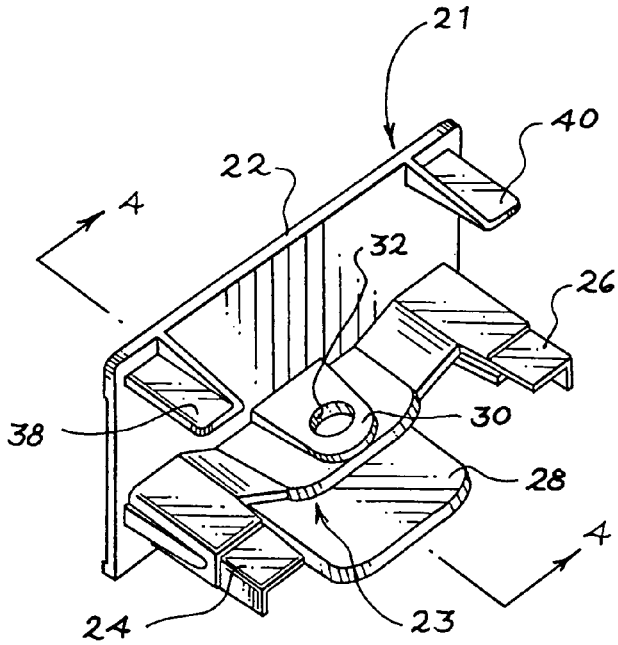
FIG. 3 is a perspective view of the securement insert of FIG. 1.
Figure 4:
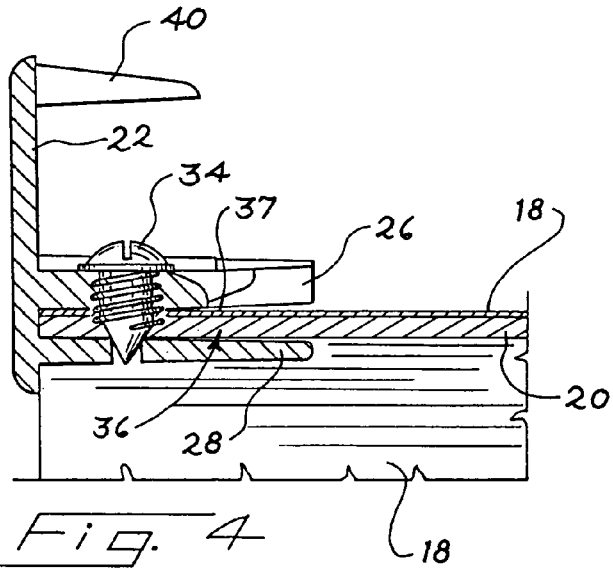
FIG. 4 is a cross-sectional side view of the securement insert of FIG. 1 along line 4-4 of FIG. 3.
Figure 5:
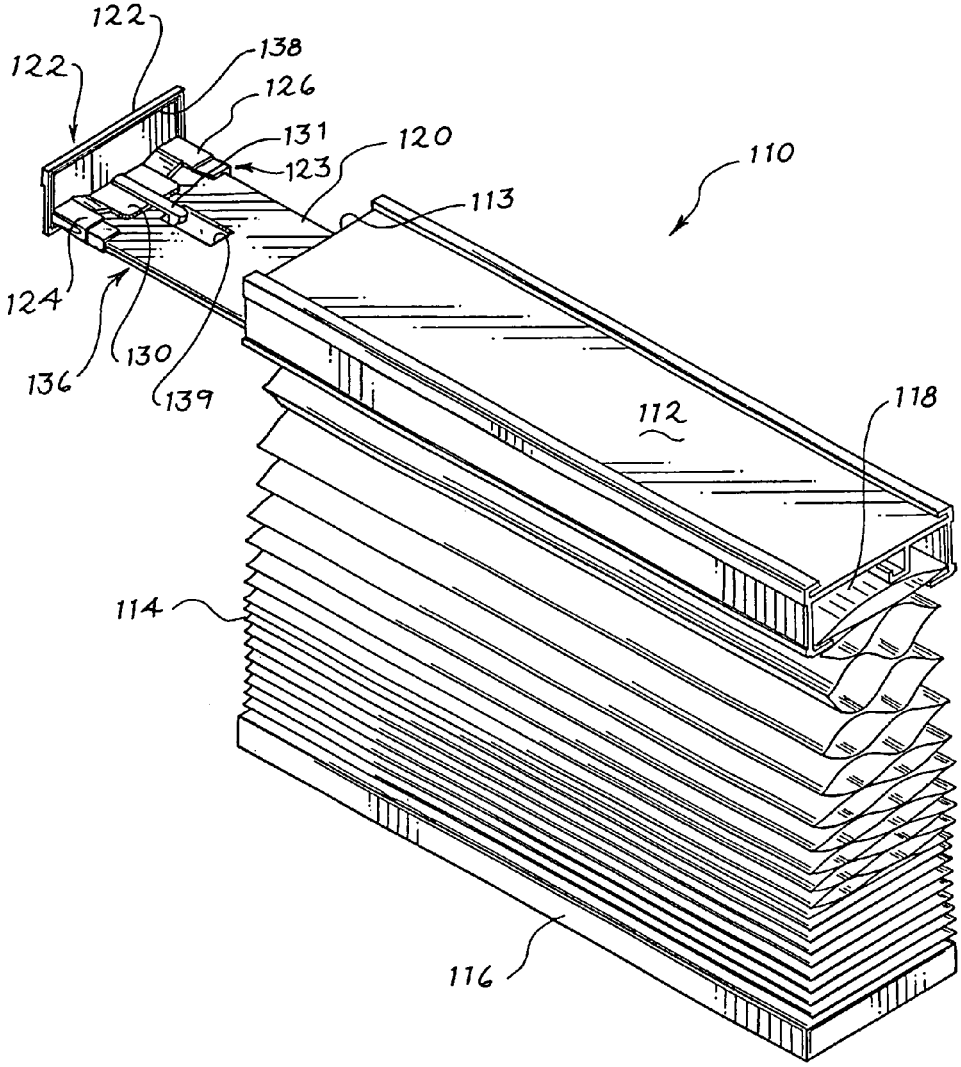
FIG. 5 is an exploded perspective view of an alternative preferred embodiment of a window covering according to the present invention.
Figure 6:
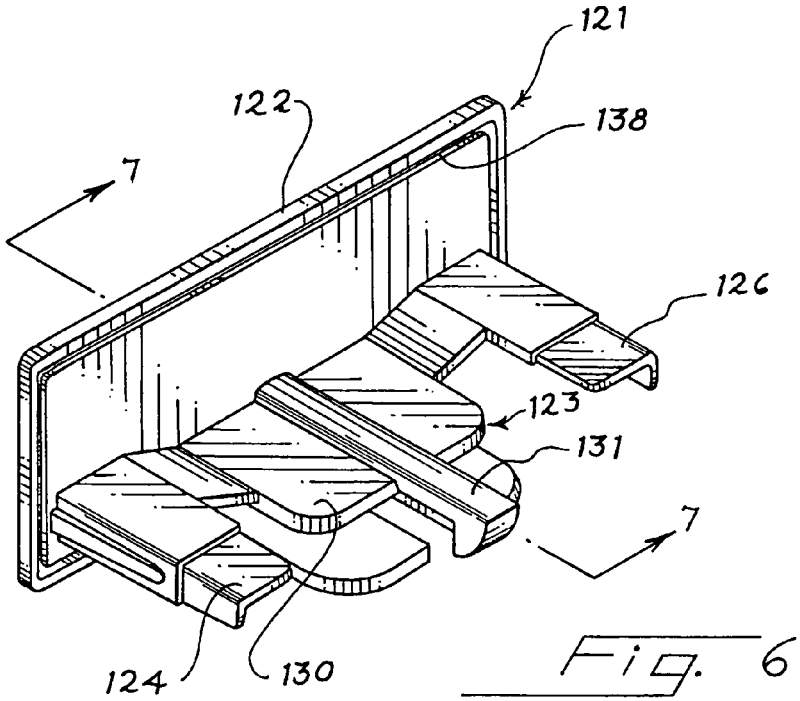
FIG. 6 is a perspective view of the securement insert of FIG. 5.
Figure 7:
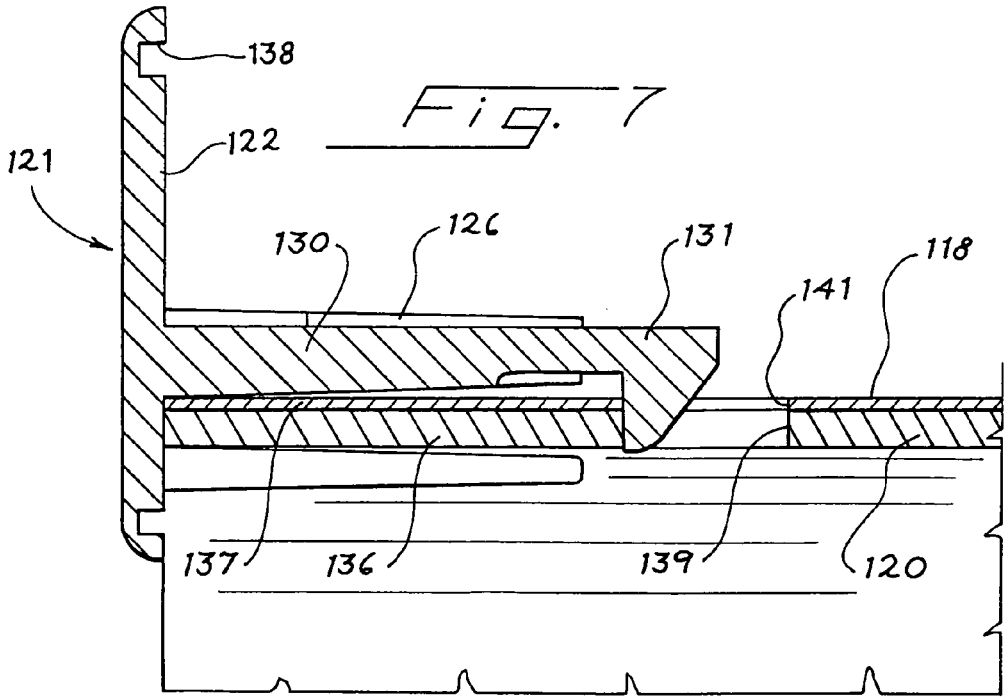
FIG. 7 is a cross-sectional side view of the securement insert of FIG. 5 along line 7-7 of FIG. 6.

In order to maintain the position of the rigid strip 20 and uppermost cell 18 in relation to the head rail 12 so as to prevent undue wear on the material, the rigid strip 20 is secured with a securement insert 21. Referring to FIGS. 3 and 4, the securement insert 21 and its securement with the rigid strip 20 and uppermost cell 18 is explained. The securement insert includes a cap 22, which is securable with an end 13 of the head rail 12. Securement insert 21 further includes a slot member 23 comprising pair of opposed brackets 24 and 26. A tongue 28 is also provided as part of the slot member 21, and provides additional lower support to the strip 20. An upper tab 30 that defines a threaded hole 32 is also provided. Referring to FIG. 4, an end portion 36 of the strip 20 and an end portion 37 of the uppermost cell are positioned within the slot member 23. A restricting member, such as pin 34, is guided through the hole 32, and either frictionally engages the end portion 36 of the strip 20 and uppermost cell 18, or, as shown, may pass through or pierce strip 20 and uppermost cell 18. In this example, the pin 34 is a threaded screw that passes through strip 20. Alternatively, the pin may be a post biased by a spring against or through the end portion 36 of strip 20 and the end portion 37 of the uppermost cell 18. Securement insert 21 also includes a pair of projections 38 and 40 integrally formed with cap 22. When the securement insert 21 is inserted into the head rail 12, projections 38 and 40 are lodged within the head rail 12, so the securement insert 21 is secured therewith by an interference fit. In addition, tongue 28 is also lodged within the head rail 12. Preferably, securement insert 21 is a single integral piece that includes the brackets 24 and 26, the tongue member 28, the upper tab 30 and the projections 38 and 40. Securement insert 21 may be formed of a variety of lightweight resiliently deformable materials, such as polyurethane, polypropylene, aluminum, or the like.

As discussed, any of the securement insert 21, strip 20 or cellular panel 14 can be disengaged from the head rail 12 such that any of the components can be repaired, cleaned, or replaced. For example, the panel 14 when soiled is typically difficult to clean or replace without replacing the entire window covering. With the present invention, however, the securement insert 21, strip 20, and cellular panel 14 can be removed from the head rail 12, and the securement insert 21 disengaged from the strip 20 and panel 14 by disengaging the restraining member, such as by removing pin 34. The strip 20 may then be removed from the uppermost cell 18 so the entire panel can be cleaned or replaced. Also, if it is desired to change the decor in a room, rather than have to replace entire window coverings, panels of different colors, textures, light transparencies, etc. can be substituted. If a cellular panel is damaged, such as a minor tear in the material, it is difficult to repair the cellular panel while in place. Rather than have to remove the entire window covering, just the cellular panel can be removed, thereby, making the repair process easier.

An alternative embodiment of the present invention is described with reference to FIGS. 5-8. Similar to the previous embodiment, a window covering 110 includes a head rail 112, a cellular panel 114, and a bottom rail 116. The uppermost cell 118 of the cellular panel 114 includes a rigid strip 120 positioned therein. The rigid strip 120 is secured with securement insert 121 by positioning an end portion 136 of the strip 120 and end portion 137 of the uppermost cell 118 in a slot member 123, such by guiding the end portion 136 into opposed brackets 124 and 126. Although not shown, the slot member 123 may also be formed by a recessed portion of the cap 122 having a cross section corresponding substantially to the cross section of the strip and uppermost cell.

In this embodiment, rather than utilize a removable restriction member, such as a pin, the restriction member is integrally formed with the securement insert 121. In this example, formed on upper tab 130 is a detent member, such as latch 131. Latch 131 is formed of a resilient material, and engages the end portion 136 of strip 120 and the end portion 137 of the uppermost cell 118. Engagement of the latch 131 with the strip 120 and uppermost cell 118 may be frictional, however, it is preferable that the end portion 136 of strip 120 and the end portion 137 of the uppermost cell 118 define sockets 139 and 141, respectively, with which a portion of the latch 131 is engaged to restrict the movement of the strip 120 and uppermost cell 118 relative to the securement insert 121. The latch can be deformed slightly to be disengaged from the strip 120 and uppermost cell 118 if it is desired to remove the securement insert 121, such as to replace the cellular panel 114.

Another alternative feature of the present embodiment relates to the securement of the securement insert 121 to the end 113 of head rail 112. In this embodiment, a recessed portion such as gutter 138 is formed in the cap 122. The gutter 138 has a cross section that corresponds to the cross section of the head rail 112. The end 113 of the head rail 112 may be inserted into gutter 138 to establish the friction fit with cap 122, thereby securing the securement insert 121 with the head rail 112.

The foregoing descriptions are to be taken as illustrative, but not limiting. Still other variants within the spirit and scope of the present invention will readily present themselves to those skilled in the art.

What is claimed is:

1. A head rail of a window covering comprising a cellular structure with an uppermost cell, at least one control member and a rigid strip positionable with the uppermost cell, the head rail comprising:

an elongated body extending substantially the width of the cellular structure;

a pair of opposed braces extending in a first direction from the body, each of the pair of braces including a shelf portion extending perpendicularly to the first direction and towards the opposite brace such that the shelf portions of the pair of braces forms a support for the rigid strip across a portion of the rigid strip; and a securement insert securable with the head rail by an interference fit, the securement insert including a cap and a slot member extending from the cap, the slot member configured to receive an end portion of the rigid strip and an end portion of the uppermost cell, and a restricting member for securing the end portion of the rigid strip and the end portion of the uppermost cell to the slot member.

2. The head rail of claim 1 wherein the slot member includes a pair of opposed brackets, and the restricting member includes an integral detent member detachably engageable with the rigid strip.

3. The head rail of claim 1 wherein the slot member includes a pair of opposed brackets and the restricting member includes a pin removably engageable with the rigid strip.

4. A window covering comprising:

a head rail;

a bottom rail;

a cellular panel including an uppermost cell;

at least one control member suspending the cellular panel and the bottom rail from the head rail;

a rigid strip positionable with the uppermost cell; and a securement insert securable with the head rail by an interference fit, the securement insert including a cap and a slot member extending from the cap, the slot member configured to receive an end portion of the rigid strip, the slot member further including a restricting member for securing the end of the rigid strip with the slot member.

5. The window covering of claim 4 wherein the slot member includes a pair of opposed brackets and the restricting member includes an integral detent member detachably engageable with the rigid strip.

6. The window covering of claim 4 wherein the slot member includes a pair of opposed brackets and the restricting member includes a pin removably engageable with the rigid strip.

* * * * *